US006018923A

United States Patent [19]

Wendt

[11] Patent Number: 6,018,923

[45] Date of Patent: Feb. 1, 2000

[54] TRANSITION CLIP FOR DRYWALL SUSPENSION GRID

[75] Inventor: Alan C. Wendt, Barrington, Ill.

[73] Assignee: USG Interiors, Inc., Chicago, Ill.

[21] Appl. No.: 08/991,935

[22] Filed: Dec. 16, 1997

[51] Int. Cl.[7] ..... E04B 9/12; E04B 9/16; E04B 9/06

[52] U.S. Cl. ..... 52/712; 52/98; 52/506.07; 52/655.1; 52/665

[58] Field of Search ..... 52/98, 506.07, 52/655.1, 712, 714, 715, 656.9, 665

[56] References Cited

U.S. PATENT DOCUMENTS

| | | | |
|---|---|---|---|
| 4,479,341 | 10/1984 | Schuplin | 52/506.07 X |
| 4,583,340 | 4/1986 | Sauer | 52/665 X |
| 4,641,987 | 2/1987 | Schlegel | 52/506.07 X |
| 5,271,202 | 12/1993 | Vukmanic et al. | 52/667 |
| 5,428,930 | 7/1995 | Bagley et al. | 52/506.07 |

OTHER PUBLICATIONS

Chicago Metallic Catalog—1 page, System Nos. 630 and 640/650 (transition soffits) (undated).

Armstrong World Industries, Inc. technical product catalog for drywall ceiling systems and accessories—7 pages: "Drywall Accessories" dated EFF. Jan. 1, 1995; Type "F" floures-cent light fixture in drywall ceiling drawing No. KW051994 dated Jun. 8, 1994; Drywall Access Door in drywall ceiling drawing No. KW051804 dated Jun. 17, 1994; Drywall Clip for 5/8" gypsum board (item No. 8878) and vertical bottom clip 15/16" flange (item No. 8880) undated; vertical bottom clip 1½" flange (item No. 8881) and drywall furring shoe/foot 1½" flange (item No. 8887) undated; drywall furring shoe 15–16" flange (item No. 8883) and drywall furring shoe combo 1½"–15–16" flange (item No. 8889 undated; and "New York City Clip" black iron to tee bulb (item No. 7897–_) and drywall furring shoe 1½" flange (item No. 8882) undated.

*Primary Examiner*—Christopher T. Kent
*Attorney, Agent, or Firm*—Lee, Mann, Smith, McWilliams, Sweeney & Ohlson

[57] ABSTRACT

The present invention is a clip used in the construction of suspended ceiling grid systems for the hanging of drywall or other panels. The clip provides a versatile means of joining two suspended grid beams at points of transition in the ceiling surface in many different intersecting orientations, thus eliminating the need for a different means of joining in each situation.

27 Claims, 6 Drawing Sheets

TRANSITION CLIP FOR DRYWALL SUSPENSION GRID

BACKGROUND OF THE INVENTION

The present invention relates to suspended drywall ceilings, which often include soffits or other changes in surface planes. Such suspended drywall ceilings are typically constructed using suspended "T" grid beams, joined to form a supporting grid system typically upon which drywall or lay-in acoustical panels can be mounted. This grid system is usually referred to as suspension grid. A "T" grid beam is an elongated beam with a flange at the bottom of the beam and a thicker "bulb" portion at the top end of the beam. Thus, the cross section of the beam resembles an inverted "T" shaped configuration. The bottom of the flange provides the grid face for the attachment of drywall or other panels. Typically, these grid beams are made of extruded aluminum or roll-formed steel, and can be straight or curved. These grid beams are joined together by clips, the subject of the present invention, allowing construction of the grid system.

Suspended "T" grid provides the easiest way of dealing with surface changes in the construction of a suspended drywall ceiling. However, such construction involves extensive on site fabrication of the grid and developing a means of securing each grid beam together. Prior art clips for suspended "T" grid beams address the problem of soffits and other transitional surfaces by offering a different clip for each condition or design detail. One of the problems with these prior art clips is that because of the need for a different clip for each transition detail, numerous clips are required for the various transitions encountered in suspended grid construction. Furthermore, these prior art clips are designed so that they accept either 15/16 inch or 1½ inch faced grid, but not both. Having to maintain a supply of so many different clips for each situation is very costly and also affects the efficiency of suspended drywall ceiling construction.

It is therefore an object of the present invention to provide a clip for joining drywall suspension grid at all points of transition that will secure suspension grid beams in more than just one configuration or design detail in a suspended drywall ceiling.

It is also an object of the present invention to provide a clip which is adapted for use with various grid face sizes, such as the 15/16 inch and the 1½ inch grid face sizes.

It is a further object of the present invention to provide a clip that does not create a "build-up" of material thickness at the points of attachment on the grid face surface upon which the drywall is attached, or on the inner surface of the grid face upon which lay-in panels rest.

SUMMARY OF THE INVENTION

The invention is a clip used to join two suspended "T" grid beams utilized in a drywall suspension grid at a point of transition, such as that to create a soffit or other change in surface planes. The clip is a substantially flat member with two extensions forming a right angle to each other. One of the extensions has a transverse flange with holes therein, disposed on one side along the bottom edge of the extension. This transverse flange provides support to the grid face of the suspended "T" grid beam and allows attachment to the back of the grid face in certain applications. In an alternate embodiment, the extension does not have a transverse flange in lay-in acoustical panel applications. This allows the acoustical panels to be laid directly upon the inside surface of the grid face of the suspended "T" grid beam without the added material thickness of the transverse flange between the panels and the beam. Each clip extension also has an extended flange with holes therein at the outermost edge of the extensions. In a preferred embodiment, the extension flanges have holes therein. These extension flanges allow further attachment options as disclosed in this specification.

The clip also has retainer members, such as channels or bendable tabs, formed along the inside edge of each extension. In a preferred embodiment, the retainer member is a channel. These retainer channels accept the "bulb" of the top edge of the suspended "T" grid beam by sliding the "bulb" into the channel. The retainer channels will also accept "T" grid beams without "bulbs" on their top edge. In the preferred embodiment, two oval shaped bosses are located on each extension and run parallel to each extension. A separate circular boss is formed at the corner of the right angle shaped clip. The raised portion of these bosses are on the side of the clip where the channels are located. These bosses allow surface contact with the center web portion of the suspended "T" grid beam. The holes through the bosses further allow attachment of the suspended "T" grid beam to the clip by the use of screws, or other similar attachment means. The clip has a weakened material zone at the intersection of the two extensions, running along a line parallel to the transverse flange. This weakened zone may be formed by perforated holes, slots, an embossed crease, or a crease created by a "V" punch or other similar method well known in the art of metal forming.

In a preferred embodiment of the invention, the clip is formed from 22 gauge cold rolled galvanized steel. The oval bosses and the circular boss are stamped into the steel. One hole is punched through the steel at each end of the oval boss. One hole is also punched through the steel at the center of the circular boss. Three holes are punched through the transverse flange and are equally spaced along the flange. Two or more holes are punched into each of the extension flanges. There is also one hole punched into each top surface of the channels. In a preferred embodiment, the channels are formed by bending the steel twice at a distance equal to the width of the channel, thus forming a channel. This width is sized to allow the "bulb" portion of the suspended "T" grid beam to be inserted into the formed channel. The outer, or second, bend of the channel is left at an angle greater than 90 degrees to the first bend, thus allowing the channel to easily fit over the "bulb" portion of the suspended "T" grid beam. In an alternate embodiment of the clip, manually field-bendable tabs are provided for securing the clip to the "bulb" portion of the "T" grid beam, instead of the channels.

The clip may be used to attach a horizontal suspended "T" grid beam and a vertical suspended "T" grid beam, such as at the top or bottom of a soffit.

The clip may also be bent along the weakened material zone at any angle, typically at a 90 degree angle, thus allowing attachment of two suspended "T" grid beams at a point of intersection of the two beams. This configuration accommodates attachment of a vertical suspended "T" grid beam to a horizontal suspended "T" grid beam that runs parallel to the edge of a soffit.

In an alternate embodiment, the clip may also be cut along the weakened material zone, thus creating two pieces of the clip. The pieces may then be attached using one hole on each extension flange of the alternate embodiment of the clip to receive a pivot pin, or the like, therethrough. This allows each piece to pivot relative to the other piece. This configuration provides attachment of two suspended "T" grid beams at a transition point in the planar surfaces of the suspended grid. The attachment may also involve a curved suspended "T" grid beam and a straight suspended "T" grid beam, thus allowing a transition from a planar surface to a curved surface. Likewise, it is possible to attach two curved suspended "T" grid beams. The two extension flanges may be offset in opposing directions, thus allowing the connection of the two clip pieces to be centered in the plane of the clip and thereby aligning the channels of each extension.

DETAILED DESCRIPTION OF THE INVENTION

Figure 1:
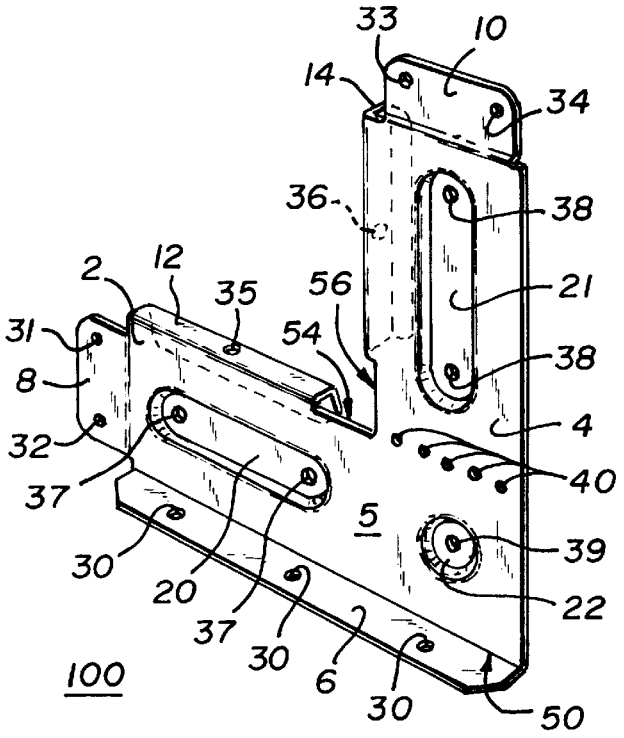
FIG. 1 is a perspective view of the clip having grid beam retainer members formed as channels.

A clip 100 is essentially a right angle bracket integrally comprising a primary extension 2 and a secondary extension 4. The secondary extension 4 meets the primary extension 2 at a joinder along a bendable and severable weakened zone comprising, in the preferred embodiment, a line of perforated holes 40, which lie along a line of intersection between the primary extension 2 and the secondary extension 4, as shown in FIG. 1. The perforated holes 40 allow the clip 100 to be bent or separated along the line of intersection of the primary extension 2 and the secondary extension 4, thus allowing the clip 100 to be used in more than just one transitional surface application of a suspended drywall ceiling. The bendable and severable line can also be created by an embossed crease, or a crease created by a "V" punch or other similar method well known in the art of metal forming. These features would also allow the clip 100 to be bent or severed along such a line. In the preferred embodiment of the invention, the clip 100 is made from metal, such as 22 gauge galvanized steel. Other materials such as plastic or composite materials may also be used. FIGS. 11–14 show the details of the clip 100.

Figure 11:
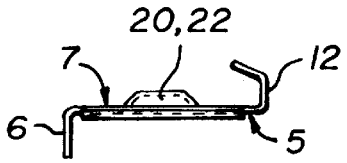
FIG. 11 is an end view of one extension of a clip.
Figure 12:
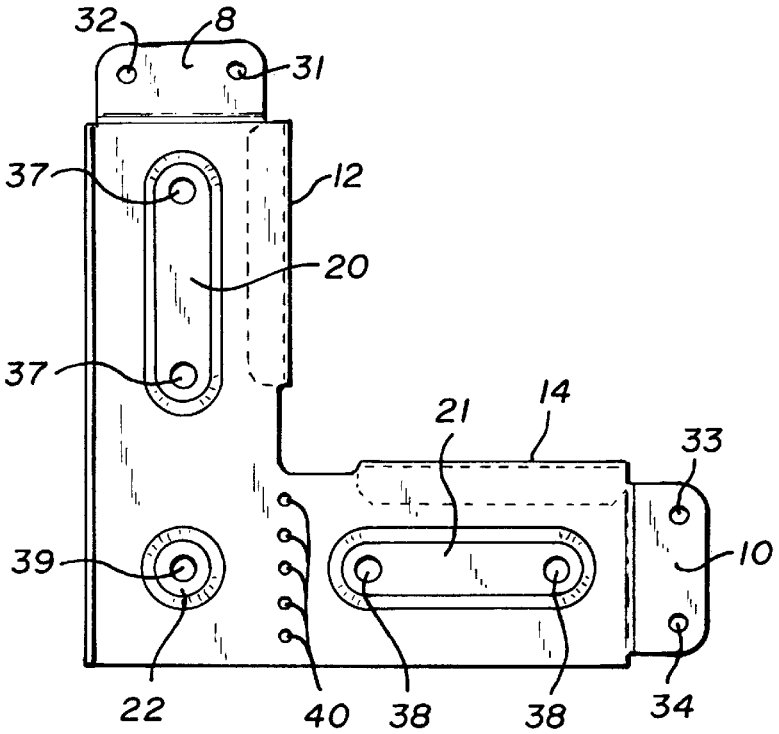
FIG. 12 is a front view of a complete clip.
Figure 13:
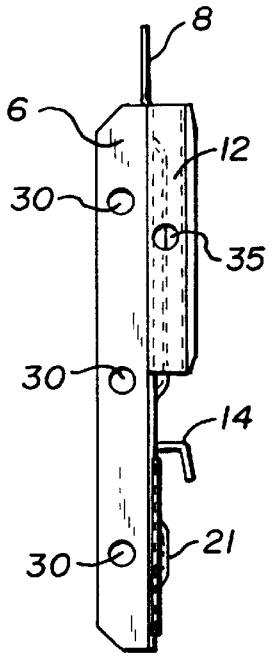
FIG. 13 is a side view of a complete clip.
Figure 14:
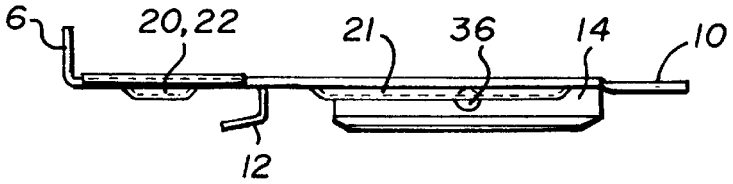
FIG. 14 is a bottom view of a complete clip.

In a preferred embodiment of the invention, as shown in FIGS. 1 and 11–14, both the primary extension 2 and the secondary extension 4 have retainer members formed as retainer channels 12 and 14, respectively, formed along inside edges 54 and 56 of the clip 100, as shown in FIG. 1. The retainer channels 12 and 14 are formed by procedures well known in the art of metal forming and fabrication. The retainer channels 12 and 14 are formed so that they are positioned on an inner bearing surface 7 side of the clip 100 and are bent to form an open angle at about 110 degrees, so that the retainer channel is splayed open, as shown in FIG. 11. A transverse flange 6 is disposed along outside edge 50 of primary extension 2 and is formed so that it extends from outer surface 5 of the clip 100, as shown in FIG. 1. When lay-in acoustical panels are being installed, an alternate embodiment of the clip 100 is utilized, wherein the clip 100 can be made to eliminate the transverse flange 6. This prevents a "build-up" of material thickness on the surface upon which the panels rest.

A primary extension flange 8 and a secondary extension flange 10 extend from the ends of the primary extension 2 and the secondary extension 4, respectively. In a preferred embodiment, the extension flange 8 is offset from the primary extension 2 towards the inner bearing surface 7 of the clip 100, while the extension flange 10 is offset from the secondary extension 4 towards the outer surface 5 of the clip 100. In an alternate embodiment, as will be described in connection with FIG. 15, the extension flanges 8 and 10 are not offset. Various holes are formed on the clip 100 to allow versatile attachment means. Holes 30 are formed through the transverse flange 6, as shown in FIG. 1. Holes 31 and 32 are formed through the primary extension flange 8 and holes 33 and 34 are formed through the secondary extension flange 10. In an alternate embodiment of the clip 100, the extension flanges 8 and 10 are eliminated. Holes 35 and 36 are formed through the top surfaces of the "U" shaped channels 12 and 14, respectively, as shown in FIG. 1.

An oval boss 20 is formed on the surface of the primary extension 2 and an oval boss 21 is formed on secondary extension 4 such that the oval bosses 20 and 21 project outwardly from the inner bearing surface 7 of the clip 100, as shown in FIG. 11. Holes 37 are formed through the oval boss 20 and holes 38 are formed through the oval boss 21. A round boss 22 is also formed on the primary extension 2 and is located at the corner of the right angle configuration of the clip 100, as shown in FIG. 1. The round boss 22 also projects outwardly from the inner bearing surface 7 of the clip 100. A hole 39 is formed through the round boss 22. In a preferred embodiment of the invention, the oval bosses 20 and 21 and the round boss 22 are formed by punching means well known in the art of metal forming and fabrication.

Figure 2:
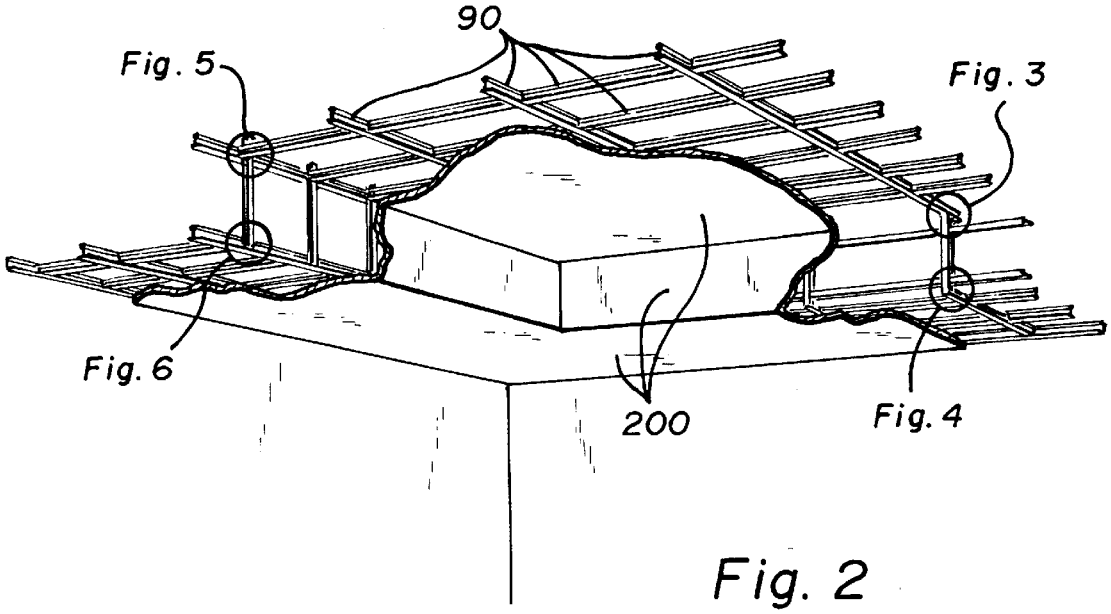
FIG. 2 is a perspective view of a suspended drywall ceiling, with a portion of the drywall cut away, thus exposing a suspended "T" grid system.
Figure 10:
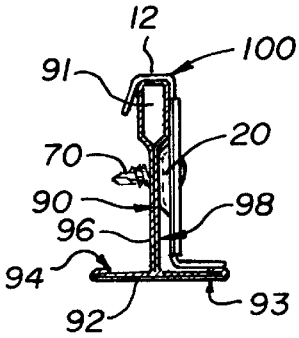
FIG. 10 is an end view of one extension of a clip attached to a suspended "T" grid beam by a screw through a boss hole on the surface of the clip extension. The "bulb" of the suspended "T" grid beam is captured by the channel on the top edge of the clip.

FIG. 2 shows a typical suspended drywall ceiling and soffit constructed with suspended "T" grid beams 90. A "T" grid beam is a beam, that when connected together with other "T" grid beams via the clip 100, forms a grid system upon which drywall 200 can be attached. FIG. 10 shows a side view of a "T" grid beam 90 attached to one extension of the clip 100. A typical "T" grid beam 90 has a stiffening "bulb" portion 91, a center web portion 96, and a base portion 92. However, other forms of the "T" grid beam may not have a "bulb" portion. The clip 100 may also be used on beams without a "bulb" portion. The base portion 92 forms the arms of the "T" shape and has a grid face 93 and a back surface 94. The drywall 200 can be attached to the grid face 93. When lay-in panels are being installed, such as lay-in acoustical panels, the panels may rest upon the back surface 94 of the "T" grid beam 90.

When a "T" grid beam 90 is attached to either the primary extension 2, or the secondary extension 4 of the clip 100, the "bulb" portion 91 of the "T" grid beam 90 is inserted into one of the retainer channels 12 or 14. Either the oval boss 21 of the secondary extension 4 or the oval boss 20 and the round boss 22 of the primary extension 2, provides a bearing surface against the center web surface 98, as shown in FIG. 10 for the oval boss 20. The clip 100 is secured to the "T" grid beam 90 by a mechanical fastener 70 inserted through one or more of the holes 37, 38, or 39 of the oval boss 20, the oval boss 21, or the round boss 22, respectively, or holes 35 and 36 of retainer channels 12 and 14, respectively. In the preferred embodiment of the invention, the mechanical fastener 70 is a screw, such as a sheet metal screw.

FIG. 2 shows several locations where two "T" grid beams are fastened together at points of transition in a suspended drywall ceiling. These situations can also be encountered when installing other panels upon the grid system, such as lay-in acoustical panels. FIGS. 3–6 show the detail of four typical transition points where the clip 100 may be used. However, the clip 100 is not limited to these situations only. FIGS. 3 through 10 depict "T" grid beams all having the same construction as "T" grid beam 90 and having the same corresponding features. Such corresponding features shall therefore be identified by the same reference numbers. However, for ease of reference to the various orientations, each individual "T" grid beam shall be given its own number.

Figure 3:
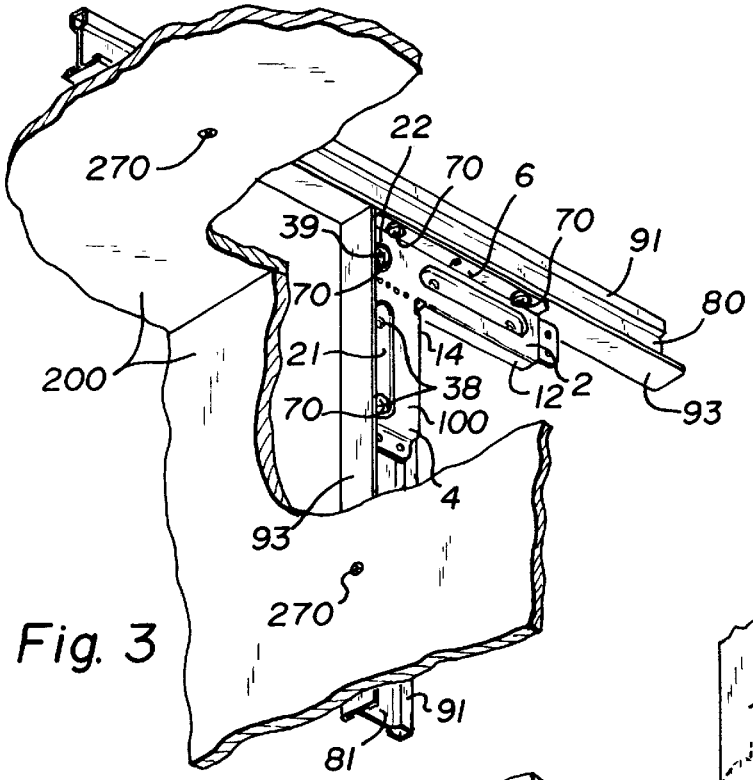
FIG. 3 is a detailed view from FIG. 2 showing a clip connection between a horizontal suspended "T" grid beam and a vertical suspended "T" grid beam terminating at the horizontal beam where the vertical axes of both grid beams are aligned in the same plane, thus forming an inner top corner of a soffit.

The clip 100 may be used at a point of transition of an inner corner of a typical soffit where there is no horizontal "T" grid beam running along the corner formed by the drywall 200, as shown in FIG. 3. In this application, the bulb portion 91 of a "T" grid beam 80 in a horizontal position is not inserted into the retainer channel 12 of the clip 100. Instead, the clip 100 is fastened to the "T" grid beam 80 through the holes 30 of the transverse flange 6 by mechanical means, such as sheet metal screws. The transverse flange 6 is fastened upon the grid face 93 of the "T" grid beam 80. The "bulb" portion 91 of a "T" grid beam 81 in a vertical position is inserted into the retainer channel 14 of secondary extension 4. The "T" grid beam 81 in the vertical position is abutted against the grid face 93 of the "T" grid beam 80 in the horizontal position, thus forming an inside corner for the drywall 200. The "T" grid beam 81 is then fastened to the clip 100 by mechanical means, such as sheet metal screws 70, through one or more of the holes 38 in the oval boss 21 of the secondary extension 4 and through the hole 39 in the round boss 22 of the primary extension 2. The drywall 200 is attached to the grid faces 93 of the "T" grid beams 80 and 81 typically by mechanical means, such as drywall screws 270. However, the drywall 200 may also be attached by adhesive means.

Figure 4A:
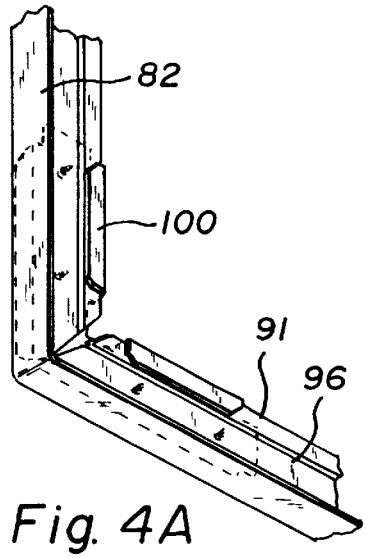
FIG. 4A is a perspective view of a clip connection similar to that in FIG. 4, except that the clip is used to reinforce a corner formed by cutting a notch in a single suspended "T" grid beam and bending the "T" grid beam to form the corner.
Figure 4:
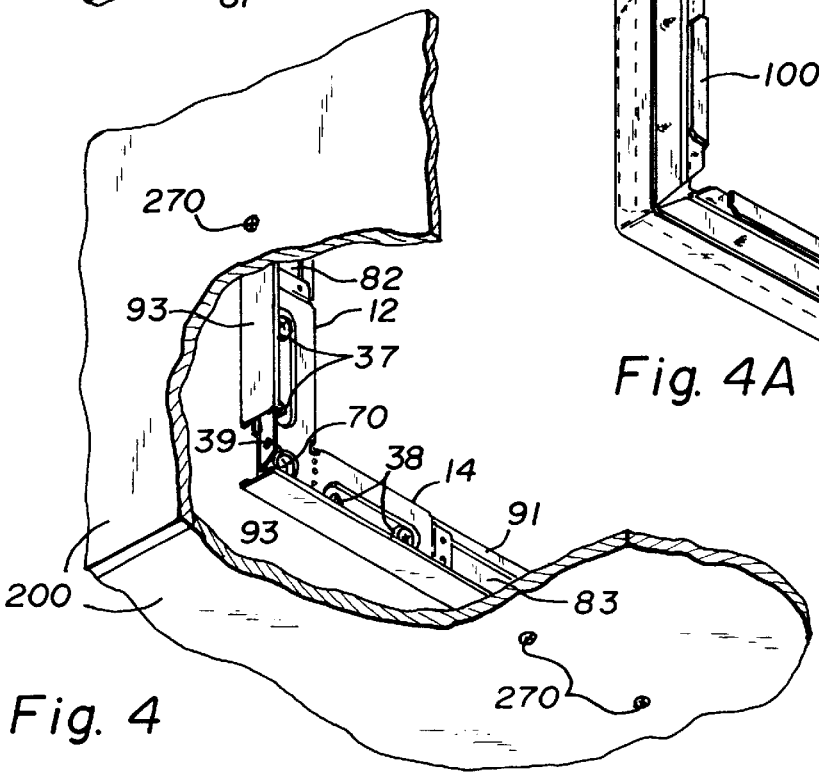
FIG. 4 is a detailed view from FIG. 2 showing a clip connection between a horizontal suspended "T" grid beam and a vertical suspended "T" grid beam where the vertical axes of both grid beams are aligned in the same plane, both beams thus forming an outside bottom corner, such as for a soffit.

The clip 100 may also be used where there is a point of transition between two "T" grid beams of an outer corner of a soffit where there is no horizontal "T" grid beam running along the corner, as shown in FIG. 4. In this application, a "T" grid beam 82 in a vertical position meets a "T" grid beam 83 in a horizontal position, thus forming an outside corner to the drywall 200. The "bulb" portions 91 of both "T" grid beams 82 and 83 are inserted into the retainer channels 12 and 14 of the clip 100, respectively. The "T" grid beams 82 and 83 are then fastened to the clip 100 by mechanical means, such as sheet metal screws 70, through one or more of the holes 37 and 38, and the hole 39. The drywall 200 is then attached to the grid faces 93 of the "T" grid beams 82 and 83 by mechanical or adhesive means.

FIG. 4A shows a similar type of corner as shown in FIG. 4. However, in FIG. 4A, the corner is formed from one "T" grid beam 82, instead of being formed by the two "T" grid beams 82 and 83. In this instance, the center web portion 96 and the "bulb" portion 91 are notched with a "V" shaped cut. This allows the "T" grid beam 82 to be bent at an angle to form a corner having lengths thereof at either side of the bend angle. The clip 100 is then used in the same manner as in FIG. 4 in order to secure the formed corner in FIG. 4A.

Figure 5:
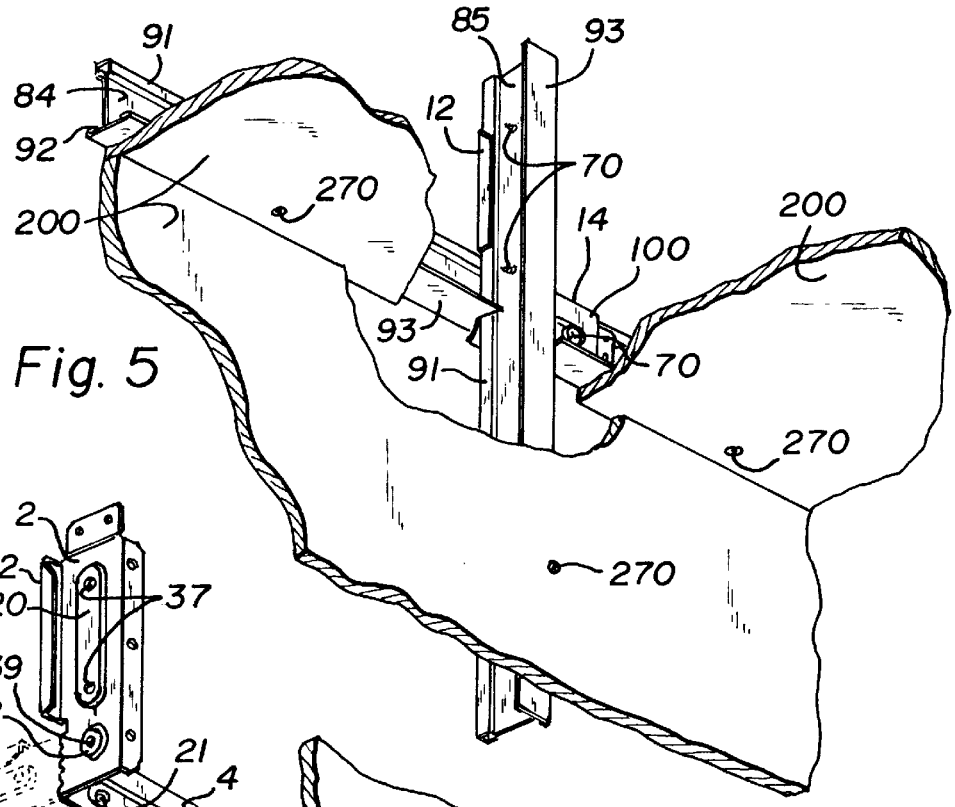
FIG. 5 is a detailed view from FIG. 2 showing a bent clip connection between a horizontal suspended "T" grid beam and a vertical suspended "T" grid beam at a point of intersection, the horizontal beam's grid face being notched to allow the vertical beam to pass through. The vertical axes of both grid beams are perpendicular to each other.
Figure 7:
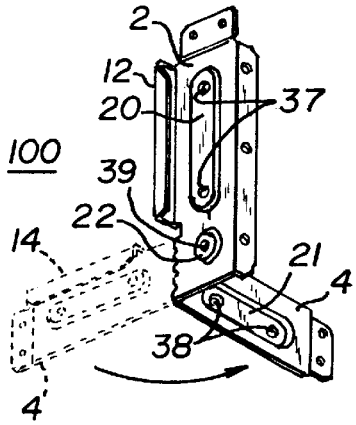
FIG. 7 shows a perspective view of a bent clip as used in FIGS. 5 and 6.

FIG. 5 shows a point of transition between two "T" grid beams 84 and 85 of an inner corner of a soffit where the "T" grid beam 84 runs horizontally along the corner of the soffit. The "T" grid beam 85 is perpendicular to the "T" grid beam 84. In this application, the base portion 92 of the "T" grid beam 84 is cut and notched to allow the "T" grid beam 85 to pass through the "T" grid beam 84 at the point of intersection. The secondary extension 4 of the clip 100 is then bent at the joinder along the perforated holes 40 in a direction opposite of the direction in which the oval bosses 20 and 21 and the round boss 22 project, such that the primary extension 2 and the secondary extension 4 are transverse to each other, as shown in FIG. 7. Referring to FIGS. 5 and 7, the clip 100 is then attached to the "T" grid beams 84 and 85 by inserting the "bulb" portions 91 of both "T" grid beams 84 and 85 into the retainer channels 12 and 14 on the clip 100. The "T" grid beams 84 and 85 are then fastened to the clip 100 by mechanical means, such as sheet metal screws 70, through one or more of the holes 37 and 38, and the hole 39. Drywall 200 is then attached to the grid faces 93 of the "T" grid beams 84 and 85 by mechanical or adhesive means.

Figure 6:
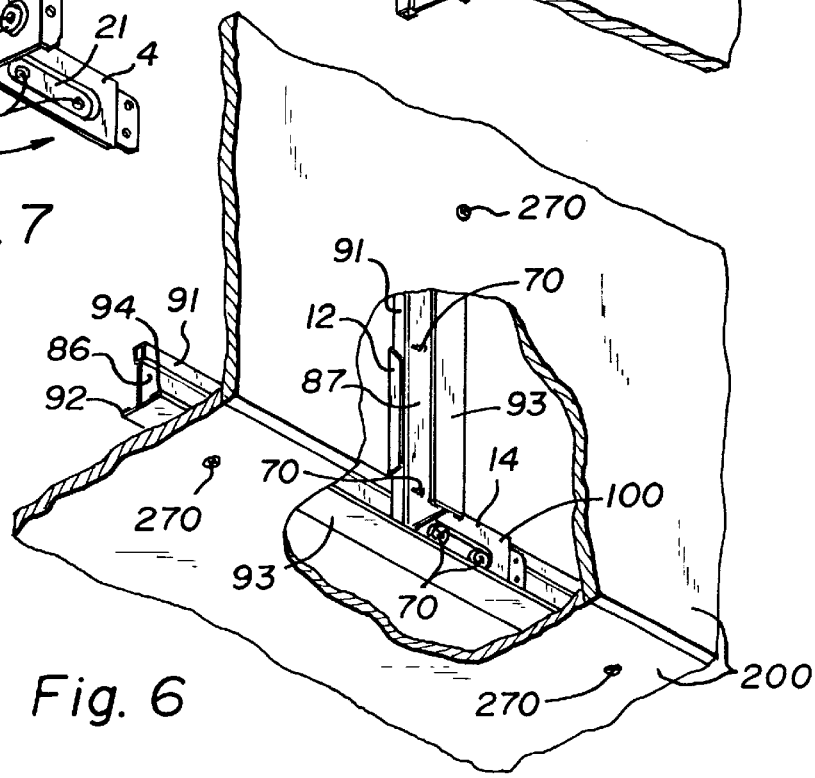
FIG.6 is a detailed view from FIG. 2 showing a bent clip connection between a horizontal suspended "T" grid beam and a vertical suspended "T" grid beam terminating at the horizontal beam. The vertical axes of both grid beams are perpendicular to each other.

Another transition point in a suspended "T" grid ceiling which utilizes the bent reconfiguration of FIG. 7 for the clip 100 is shown in FIG. 6. This application involves a transition point of an outer corner of a soffit where a horizontal "T" beam 86 runs along the corner of the soffit. In this configuration, a vertical "T" beam 87 sets upon the back surface 94 of the base portion 92 of the "T" grid beam 86. The bent configuration of the clip 100, as shown in FIG. 7, is then attached to both the "T" grid beams 86 and 87 by inserting the "bulb" portions 91 of both "T" grid beams 86 and 87 into the retainer channels 12 and 14 on the clip 100, as shown in FIG. 6. The "T" grid beams 86 and 87 are then fastened to the clip 100 by mechanical means, such as sheet metal screws 70, through one or more of the holes 37 and 38, and the hole 39. These holes are shown in FIG. 7. The drywall 200 is then attached to the grid face 93 of the "T" grid beams 86 and 87 by mechanical or adhesive means.

Figure 8:
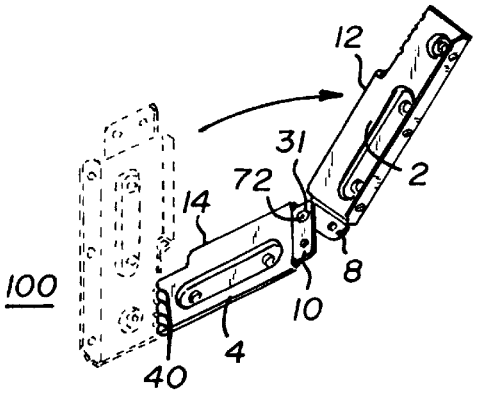
FIG. 8 shows a perspective view of a clip severed along the perforation holes, thus creating two clip extension pieces. The pieces are pivotally joined at the upper holes through the offset extension flanges, thus allowing the two pieces to pivot in relation to each other.
Figure 9:
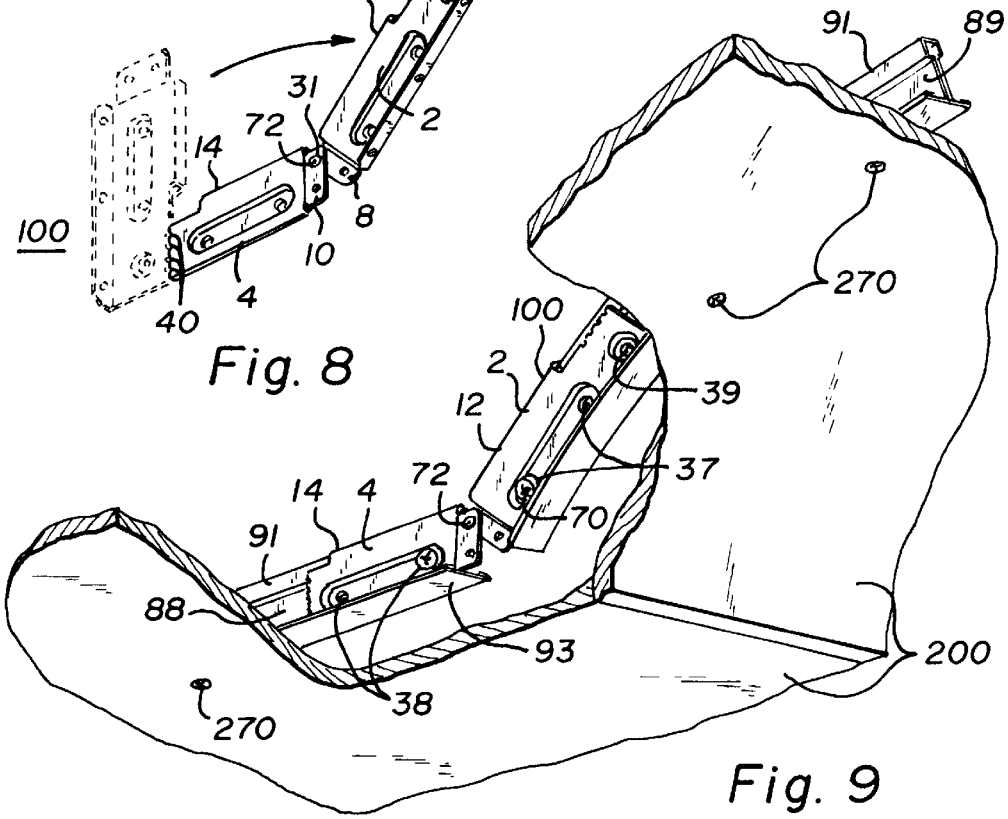
FIG. 9 is a perspective view of a suspended drywall ceiling, with a portion of the drywall cut away and exposing a severed clip pivotal connection between a straight suspended "T" grid beam and a curved suspended "T" grid beam, thus forming a corner transition between a planar surface and a curved surface.

FIG. 9 shows a point of transition where two drywall surfaces 200 of a ceiling intersect at an angle. The drywall surfaces 200 may be planar or curved. In FIG. 9, a "T" grid beam 88 is straight horizontally and is attached to a curved "T" grid beam 89. This type of attachment requires a two piece re-configuration of the clip 100, as shown in FIG. 8. The secondary extension 4 of the clip 100 is separated from the primary extension 2 by severing them at the joinder along the perforated holes 40 of the clip 100, thus forming two pieces. The primary extension 2 is then loosely pivotally fastened to the secondary extension 4 through the hole 31 on the primary extension flange 8 and through the hole 33 on the secondary extension flange 10 by mechanical means, such as a rivet 72. In a preferred embodiment of the clip 100, the primary extension flange 8 is offset from the primary extension 2 in an opposite direction of the offset between the secondary extension flange 10 and the secondary extension 4, both offsets being equal. These offsets allow the primary extension 2 and the secondary extension 4 to be fastened so that both of the retainer channels 12 and 14 are aligned on the same axis and in the same plane of the bulb portions 91 of "T" grid beams 88 and 89. FIG. 8 illustrates the proper attachment of the primary extension 2 and the secondary extension 4 of this two piece re-configuration of the clip 100. Referring again to FIG. 9, both of the "T" grid beams 88 and 89 are then attached to the two piece configuration of the clip 100 by inserting the "bulb" portions 91 of both "T" grid beams 88 and 89 into the retainer channels 12 and 14 on the clip 100. The "T" grid beams 88 and 89 are then fastened to the clip 100 by mechanical means, such as sheet metal screws 70, through one or more of the holes 37 and 38, and the hole 39. Drywall 200 is then attached to the grid faces 93 of the "T" grid beams 88 and 89 by mechanical or adhesive means.

Figure 15:
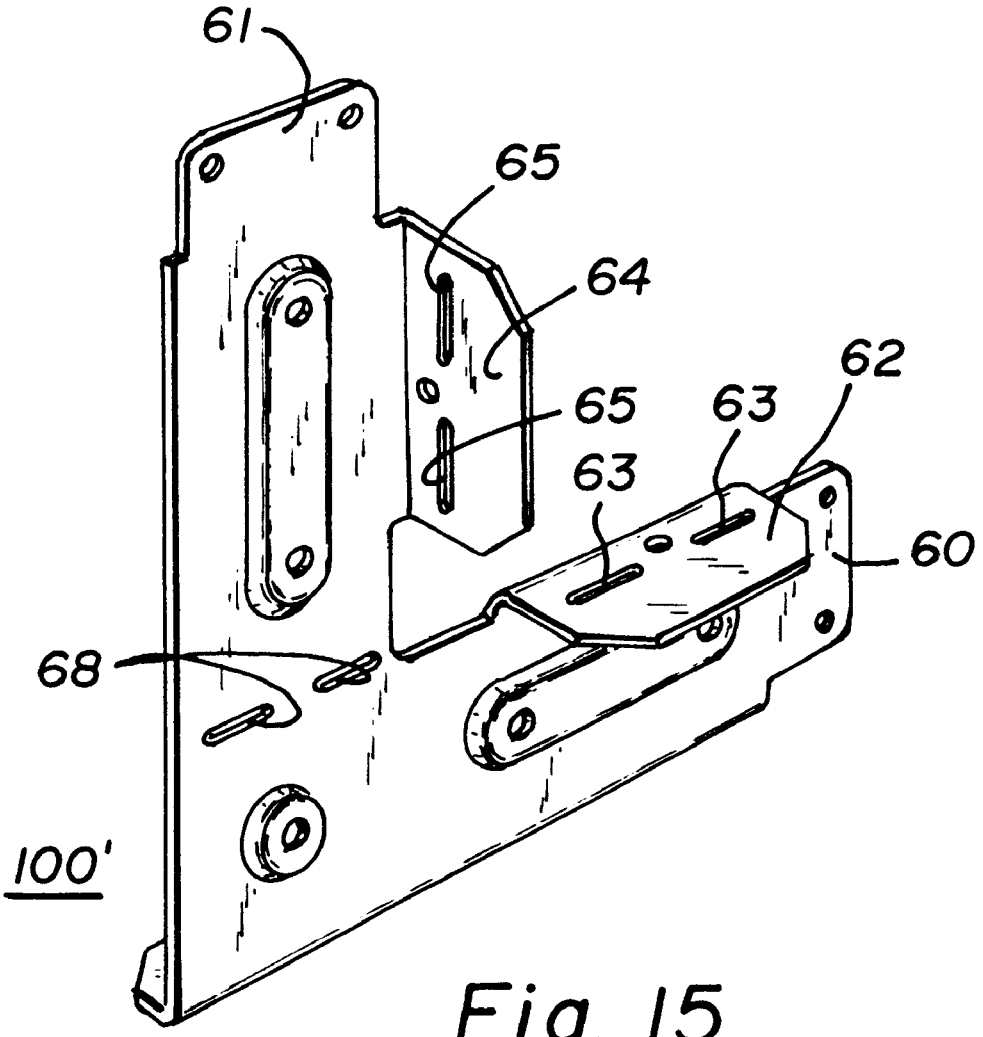
FIG. 15 is a perspective view of an alternate embodiment of the clip having grid beam retainer members formed as bendable tabs for securing the clip to the "T" grid beam and non-offset extension flanges.

FIG. 15 shows an alternate embodiment as clip 100'. The retainer members of the clip 100' in this embodiment are bendable retainer tabs 62 and 64, bendable along slots 63 and 65, respectively. The retainer tabs 62 and 64 are bent over the top portion of a "T" grid beam in order to secure the clip 100' in place. Instead of having a retainer channel already formed on the clip, retainer tabs 62 and 64 can be bent in the field during installation. FIG. 15 also illustrates slots 68 as an alternate embodiment of the weakened material zone. The clip 100' can be bent or severed along the slots 68. This embodiment also has extension flanges 60 and 61, which have no offsets. However, extension flanges 60 and 61 can also have offsets as shown in the preferred embodiment of FIG. 1.

While specific embodiments of the present invention have been shown here for the purposes of explaining preferred and alternate embodiments of the invention, it is to be understood that the appended claims have a wide range of equivalents and a broader scope than the embodiments disclosed.

What is claimed is:

1. A clip for suspension ceiling grid beams comprising:

a primary extension having first and second sides;

a secondary extension having first and second sides, said secondary extension integrally connected to said primary extension;

a first channel formed along said primary extension along a first edge of said primary extension and projecting away from the first side of said primary extension; and a second channel formed along said secondary extension along an edge of said secondary extension and projecting away from the first side of said secondary extension;

said secondary extension bendable along a line generally parallel to said first edge of said primary extension.

2. The clip as recited in claim 1, wherein said clip includes a weakened zone along a line parallel to said first edge of said primary extension.

3. The clip as recited in claim 2, wherein said primary extension having a transverse flange connected perpendicular to and along a second edge opposite to said first edge, said transverse flange extending from the second side of said primary extension.

4. The clip as recited in claim 3, wherein said transverse flange has holes therethrough.

5. The clip as recited in claim 2, wherein said primary extension having an extension flange extending from a third edge being transverse to the first edge, said extension flange being parallel to said primary extension.

6. The clip as recited in claim 5, wherein said extension flange has holes therethrough.

7. The clip as recited in claim 2, wherein said secondary extension having an extension flange extending from another edge being transverse to said edge, said extension flange being parallel to said secondary extension.

8. The clip as recited in claim 7, wherein said extension flange has holes therethrough.

9. The clip as recited in claim 2, wherein said primary and secondary extensions having raised bosses thereon, said raised bosses projecting outwardly from the first sides of said primary and secondary extensions having said first and second retainer members.

10. The clip as recited in claim 9, wherein said raised bosses having holes therethrough.

11. The clip as recited in claim 1, wherein said clip is formed out of metal.

12. The clip as recited in claim 9, wherein said raised bosses are stamped to project from said primary and secondary extensions.

13. A clip for suspension ceiling grid beams comprising:

a primary extension having first and second sides;

a secondary extension having first and second sides, said secondary extension integrally connected to said primary extension;

a weakened zone at the integral connection between said primary and secondary extensions;

a first retainer member formed along said primary extension along a first edge of said primary extension and projecting away from the first side of said primary extension; and a second retainer member formed along said secondary extension along an edge of said secondary extension and projecting away from the first side of said secondary extension.

14. The clip as recited in claim 13, wherein said weakened zone extends along a line.

15. The clip as recited in claim 14, wherein said line is parallel to said primary extension.

16. The clip as recited in claim 15, wherein said clip has perforations along said line.

17. The clip as recited in claim 13, wherein said weakened zone is a hinge.

18. The clip as recited in claim 17, wherein said hinge extends along a line.

19. The clip as recited in claim 18, wherein said line is parallel to said primary extension.

20. The clip as recited in claim 19, wherein said hinge is formed by perforations therethrough along said line.

21. The clip as recited in claim 19, wherein said hinge is formed by a groove along said line.

22. The clip as recited in claim 13, wherein said weakened zone is severable.

23. The clip as recited in claim 22, wherein said weakened zone extends along a line.

24. The clip as recited in claim 23, wherein said line is parallel to said primary extension.

25. The clip as recited in claim 24, wherein said weakened zone is formed by perforations therethrough along said line.

26. The clip as recited in claim 24 wherein said weakened zone is formed by a groove along said line.

27. A clip for suspension ceiling grid beams comprising:

a primary extension having first and second sides;

a secondary extension having first and second sides, said secondary extension integrally connected to said primary extension to form a generally co-planar flat configuration with said primary extension in plan;

a first channel formed along said primary extension along a first edge of said primary extension and projecting away from the first side of said primary extension; and a second channel formed along said secondary extension along an edge of said secondary extension and projecting away from the first side of said secondary extension.

* * * * *